United States Patent [19]

McBride

[11] Patent Number: 4,679,334

[45] Date of Patent: Jul. 14, 1987

[54] FOOTWEAR HEEL-LOCK SUPPORT STRAPPING SYSTEM

[76] Inventor: Frank McBride, 631 Chicago Blvd., Detroit, Mich. 48202

[21] Appl. No.: 938,232

[22] Filed: Dec. 4, 1986

Related U.S. Application Data

[63] Continuation-in-part of Ser. No. 820,806, Jan. 20, 1986, abandoned.

[51] Int. Cl.[4] ..... A43B 3/12; A43B 5/06

[52] U.S. Cl. ..... 36/114; 36/11.5; 36/91; 128/586

[58] Field of Search ..... 36/50, 58.5, 58.6, 11.5, 36/89, 92, 91, 105, 110, 114; 12/142 LC; 128/80 D, 153, 586

[56] References Cited

U.S. PATENT DOCUMENTS

| | | | |
|---|---|---|---|
| 1,572,213 | 2/1926 | Lucas | 36/11.5 |
| 2,265,853 | 12/1941 | Nussbaum | 128/586 |
| 2,788,591 | 4/1957 | Gibson | 36/91 |
| 3,327,410 | 6/1967 | Park, Sr. et al. | 36/91 |
| 3,748,757 | 7/1973 | Silver | 36/11.5 |
| 4,446,633 | 5/1984 | Scheinhaus et al. | 36/11.5 |
| 4,476,639 | 10/1984 | Zaccaria | 36/50 |

FOREIGN PATENT DOCUMENTS

| | | | |
|---|---|---|---|
| 1947245 | 3/1971 | Fed. Rep. of Germany | 36/11.5 |
| 897884 | 4/1945 | France | 36/11.5 |
| 954439 | 12/1949 | France | 36/11.5 |
| 2147792 | 5/1985 | United Kingdom | 36/11.5 |

*Primary Examiner*—Werner H. Schroeder
*Assistant Examiner*—Steven N. Meyers
*Attorney, Agent, or Firm*—Robert G. Mentag

[57] ABSTRACT

A heel-lock support strapping system for use in sandals, slipper type shoes, low-cut shoes, boots, and like footwear. A heel support strap is wound from the heel end portion of the footwear and thence over the instep of the foot of a wearer and under the arch of said foot at least one time, and thence back over the instep, with the two ends of the strap then being releasably secured together. The heel support strap forms a figure eight from an anchored position at the heel end portion of the footwear.

5 Claims, 5 Drawing Figures

FOOTWEAR HEEL-LOCK SUPPORT STRAPPING SYSTEM

This application is a continuation-in-part application of prior application Ser. No. 820,806 filed on Jan. 20, 1986, now abandoned.

BACKGROUND OF THE INVENTION

1. Technical Field

The field of this invention relates to a heel-lock support strapping system for use in footwear, such as sandals, shoes, boots and the like. Class 36, Subclass 114, United States Patent and Trademark Office Classification, appears to be the applicable general area of art to which the subject matter similar to this invention has been classified in the past.

2. Background Information

It is known in the footwear art to provide various types of strap fastening devices for securing footwear such as a sandal, a shoe and the like, to the foot of a wearer. However, the prior art strapping systems for footwear have disadvantages in that they do not prevent sideward and forward slippage, and upward and downward movement of the heel of a wearer's foot in footwear, such as a sandal or the like, during running or other walking foot action. One arrangement for providing a shoe with an adjustable strap fastening mechanism is shown in U.S. Pat. No. 4,476,639. The adjustable strap fastening mechanism shown in this patent does have a strap which passes under the arch of the wearer's foot, but it does not secure the heel or rear portion of a foot of a wearer to the heel end portion of a shoe, or the like, to prevent upward or lateral movement of the rear foot portion of the wearer of the shoe. U.S. Pat. No. 3,234,667 shows a shoe having an inside flexible strap which extends from the inside heel area to the instep of the shoe, where the upper ends of the flexible strap are secured together by a conventional shoe lace. The flexible strap extends from the heel area of the shoe shown in this patent, but it does not provide arch support.

U.S. Pat. Nos. 1,167,019 and 2,590,648 show sandals having attachment straps, but neither of these patents teach the use of a heel support strap which secures the foot of a wearer to the heel end portion of a sandal, or other type footwear, providing a snug arch support in one cohesive action.

SUMMARY OF THE INVENTION

In accordance with the present invention, a heel-lock support strapping system and method is provided for use in sandals, slippers, low-cut shoes, and boots. In accordance with the invention, a heel support strap is secured or anchored to the footwear at the heel end portion, either under the insole or on the top of the insole. The ends of the heel support strap are then wrapped upwardly at an angle from the inside of the heel, and one end of the heel support strap is wound over the instep of the foot of the wearer and under the arch, and thence back over the instep, and it is then releasably secured to the other end of the heel support strap, on the outside of the heel. The heel support strap forms a figure eight from an anchored position at the heel end portion of the footwear, providing a snug arch support while securing the heel of the wearer to the footwear. The heel-lock support strapping system of the present invention prevents sideward and forward slippage, and upward and downward movement of the heel of the foot of a wearer in a footwear, and it provides a stable rear foot position with a constant snug arch support throughout running or walking foot action. The strapping system of the present invention creates a force to pull the heel area of the foot of a wearer downward and backward into a steadfast engagement with the footwear without placing strap pressure on the achilles tendon.

The heel-lock support strapping system of the present invention is especially advantageous for use in a running type sandal, which may be employed for vigorous activity such as running, jumping or in negotiating rugged terrain. The heel-lock support strapping system of the present invention is simple in structure and economical to manufacture.

DESCRIPTION OF THE PREFERRED EMBODIMENTS

Figure 1:
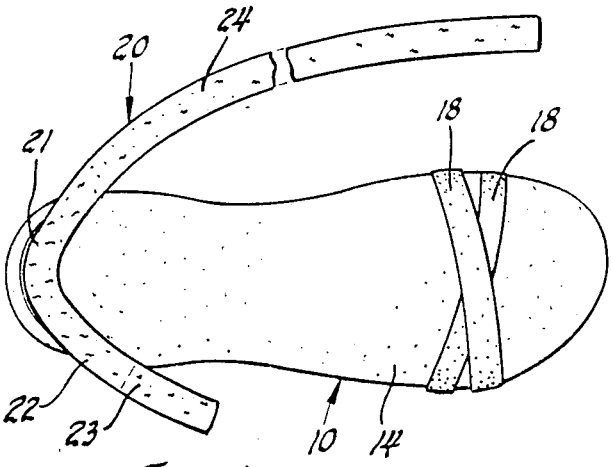
FIG. 1 is a top view, of a sandal for the right foot of a person, and which embodies the principles of the present invention.
Figure 2:
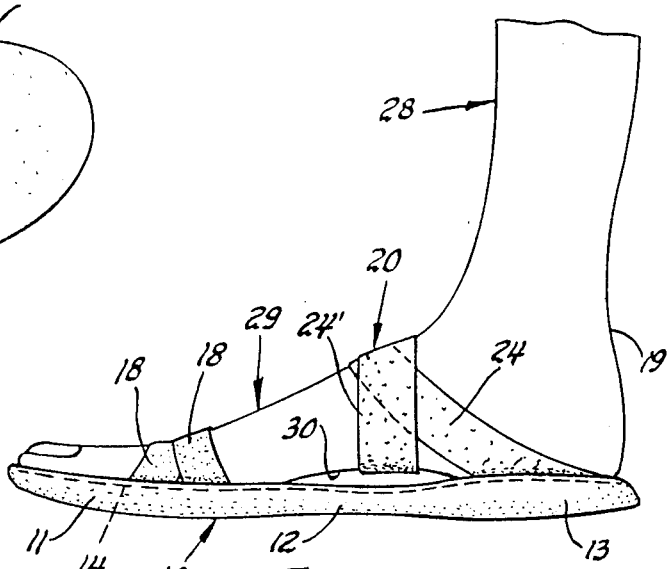
FIG. 2 is an inside elevation view, of the sandal illustrated in FIG. 1, and showing the sandal worn on a wearer's right foot.

Referring now to the drawings, and in particular to FIG. 1, the numeral 10 generally designates a conventional sandal of a type which may be used as a running sandal. It will be understood, that although the heel-lock support strapping system of the present invention is illustrated as being applied to a sandal, the invention is applicable to other types of footwear, as for example, low-cut walking or running shoes, slipper type shoes, boots, and the like. As shown in FIG. 2, the sandal 10 includes an outsole which has a front or toe portion 11, an integral or central arch portion 12, and an integral rear or heel portion 13. The sandal 10 is shown in FIGS. 1, 2 and 3 as being provided with an insole 14.

Figure 3:
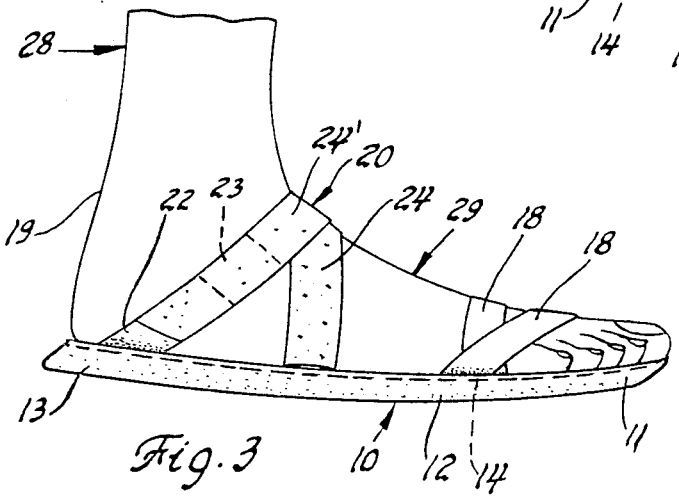
FIG. 3 is an outside elevation view, of the sandal illustrated in FIG. 1, and showing the sandal worn on a wearer's right foot.

As shown in FIGS. 1 through 3, the sandal 10 is provided with a pair of transversely disposed conventional straps 18 for retaining the forward part of a wearer's foot on the sandal.

As shown in FIGS. 1, 2 and 3, the sandal 10 is provided with a heel support strap, generally indicated by the numeral 20. The heel support strap 20 may be made from any suitable material, as for example an elastic material or from a firm, non-elastic material. In one embodiment the heel support strap 20 was approximately twenty-seven inches in length, and it may be approximately $\frac{3}{4}$ inches to $1\frac{1}{2}$ inches in width.

As shown in FIG. 1, the heel support strap 20 has an intermediate portion 21 which may be anchored or secured in place on the sandal 10 by any suitable means, as by being glued to the top surface of the outsole heel portion 13 or the insole 14, or under the insole 14, by a hook and pile type fastening means or by stitching to the insole 14. It will be understood, that although the heel support strap portion 21 is shown as being disposed on top of the insole 14, that it could also be disposed under the insole 14. Also, it will be understood that although the heel support strap intermediate portion 21 is located in FIG. 1 at the extreme rear end of the insole 14 that it could be disposed slightly forward from the rear end of the insole 14.

As shown in FIG. 1, the heel support strap 20 has a first or outside end portion 22 integrally connected to the fixed portion 21 and extending upwardly and forwardly at an acute angle, as an angle of approximately 35 to 45 degrees, from the longitudinal plane of the footwear. The heel support strap outside end portion 22 is provided with a fastening means on the extreme end thereof, in the form of a plurality of conventional "VELCRO" type hooks disposed over the end area indicated by the numeral 23.

As shown in FIG. 1, the second or inside end portion of the heel support strap 20 is integral with the anchored intermediate portion 21, and it extends upwardly and forwardly at an acute angle from the longitudinal plane of the footwear. The heel strap second end portion is of a length sufficient to be first wound from the inside of the heel end portion of the footwear and over the base of the instep of the foot 29 of the leg 28 of the wearer of the sandal 10, and thence directly downward and under the arch 30 of the foot 29, as indicated by the numeral 24' in FIG. 2.

As shown in FIG. 3, the end of the heel support strap portion 24 is then brought upwardly and back over the base of the instep of the foot 29 and then rearwardly and downwardly at an acute angle from the longitudinal plane of the footwear, and it is secured on the outside of the first heel strap portion 22. The numeral 24' indicates the heel strap portion which is wound over the first portion of the strap 24 and secured to the strap end prtion 22. It will be seen that the heel strap 20 is secured to a wearer's foot 29 by a retaining strap structure which forms a figure eight from an anchored position at the inside base of the heel of the footwear to create a force to pull the rear portion of the foot of a wearer downward and back into a steadfast engagement with the footwear to provide a positive rear-foot control, while allowing the achilles tendon 19 to function freely from any restrictive strap pressure.

The inside surface of the heel strap end portion 24 is formed of the usual soft "VELCRO" type material, which coacts with the "VELCRO" hook type material on the end portion 23 of the heel strap end portion 22, for fastening the strap end portion 24 to the strap end portion 22, for securing the sandal 10 on the wearer's foot 29. It will be understood that fastening means other than the illustrated "VELCRO" means, such as buckles, fastener strings, and the like, could be employed for fastening the heel strap end portion 24 to the end portion 22. It will also be understood that the strapping technique could be reversed with the fastening means disposed on the inner side of the sandal, instead of on the outer side of the sandal, as shown in FIG. 3.

In use, it will be seen that the heel support strap 20 functions to secure the rear portion of a wearer's foot 29 to the sandal or other footwear 10, and to provide a snug arch and ankle support without encroachment on the achilles tendon 19. The foot support provided by the heel support strap 20 is additive to the arch support of the sandal or other footwear 10. It has been found that the heel support strap 20 is advantageous in that it keeps a foot 29 from sliding forward when the footwear 10 is worn, and especially during a running action. It has also been found that the heel support strap 20 provides stability for the rear portion of a foot during lateral and up and down movements of the footwear, such as when the strap 20 is employed on a running sandal as illustrated by the sandal 10 in FIGS. 1 through 3.

As stated hereinbefore, the heel-lock support strapping system of the present invention may be used on any type of footwear, however, it is particularly advantageous for vigorous activity applications or for use by individuals requiring a constant firm arch support.

Figure 4:
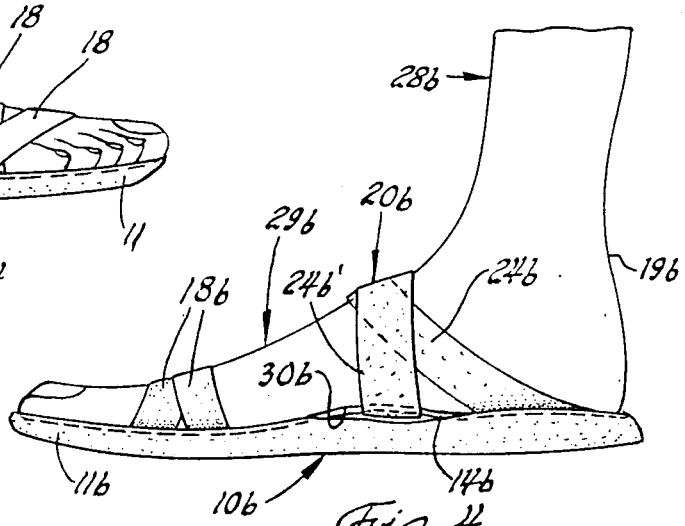
FIG. 4 is an inside elevation view, of a second embodiment of the invention, similar to the view of FIG. 2, and showing the heel support strap wound over the wearer's instep and under the sandal insole.

FIG. 4 illustrates a second embodiment of the invention, and the reference numerals employed in the embodiment of FIG. 4 are the same as employed in the embodiment of FIGS. 1 through 3, followed by the small letter "b".

In the embodiment of FIG. 4, the support strap end portion **24*b* is shown as being wound around the instep of a wearer's foot 29*b*, and thence under the insole 14*b* of the sandal 10*b* and back over the instep, as shown by the numeral 24*b'*, and then to the outsde to be secured in position in the same manner as illustrated in FIG. 3. The heel support strap 20*b* is wound in the same figure eight configuration as shown in FIGS. 2 and 3, but it will be understood that the winding of the support strap 20*b* under the insole 14*b*** disperses the strap pressure under the arch of the wearer and facilitates keeping the strap in place for donning purposes.

Figure 5:
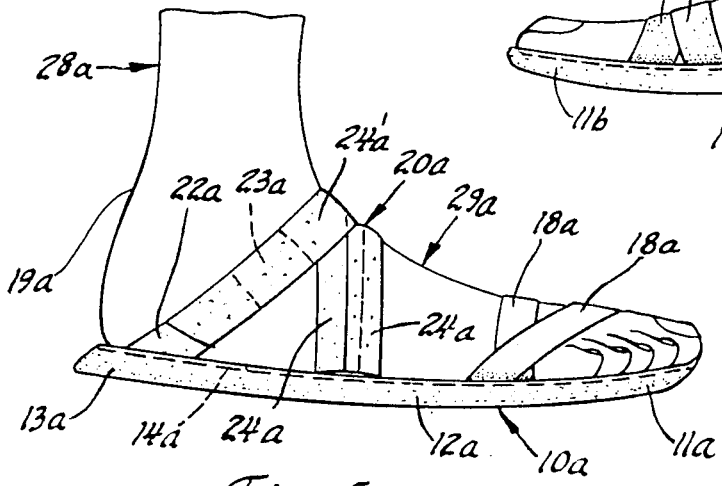
FIG. 5 is an outside elevation view, of the sandal illustrated in FIG. 1, and similar to FIG. 3, and showing the heel support strap wound over the wearer's instep in a double arch wrap for added arch support.

FIG. 5 illustrates another embodiment, and the reference numerals employed in FIG. 5 are the same as the reference numerals employed in the embodiment of FIGS. 1 through 3, followed by the small letter "a".

In the embodiment of FIG. 5 the heel support strap **20*a* is made to a longer length then the strap 20 shown in the embodiment of FIGS. 1 through 3, so as to provide a double wrap of the strap end portion 24*a* about the instep and arch of the foot 29*a* of a wearer of the sandal 10*a*. The longer heel support strap 20*a* is also wrapped in a figure eight configuration and it provides added arch support for the user of the embodiment of FIG. 5**.

It will be obvious that the heel-lock support strapping system of the present invention may be employed on footwear having low-cut or high sides, and in such instances it would be necessary to extend the heel support strap through openings in said sides.

What is claimed is:

1. In an article of footwear, adapted for application to the foot of a wearer, and having a heel end portion, a heel-lock support strapping system comprising:

(a) a heel support strap disposed at the heel end portion of the footwear and having a first end portion extended upwardly and forwardly at an acute angle from the longitudinal plane of the footwear from one side of the heel end portion of the footwear, and having a second end portion extended upwardly and forwardly at an acute angle from the longitudinal plane of the footwear from the other side of the heel end portion of the footwear;

(b) means for anchoring the heel support strap to the article of footwear at the heel end portion of the footwear;

(c) said second end portion of the heel support strap being longer than said first end portion, and being adapted to be wound over the base of the instep of the foot of a wearer of the article of footwear, and thence directly downward and under the arch of said foot and back upwardly over said base of the instep, and thence rearwardly and downwardly at an acute angle from the longitudinal plane of the footwear to a fastening position with said first end portion of the heel support strap to form a figure eight to create a force to pull the rear portion of the foot of said wearer downward and backward into a steadfast engagement with the footwear to provide a positive rear-foot control, while allowing the achilles tendon to function freely from any restrictive strap pressure; and, (d) fastening means for securing said second end portion of the heel support strap to said first end portion.

2. An article of footwear as defined in claim 1, wherein the second end portion of the heel support strap is adapted to be wound over the base of the instep and under the arch of the foot of said wearer a plurality of times and thence to said fastening position.

3. An article of footwear as defined in claim 1 and having an insole, wherein the second end portion of the heel support strap is adapted to be wound over the base of the instep of the foot of said wearer, and thence under the insole of the footwear and back over said base of the instep to said fastening position.

4. A method of releasably securing the foot of a wearer to an article of footwear having a heel end portion, including the steps of:

(a) providing a heel support strap having an intermediate portion, a first integral end portion and a second integral end portion longer than said first integral end portion;

(b) anchoring said heel support strap intermediate portion to the article of manufacture at the heel end portion with said heel support strap first end portion extended upwardly and forwardly at an acute angle from the longitudinal plane of the footwear from one side of the heel end portion of the footwear, and with the heel support strap second end portion extended upwardly and forwardly at an acute angle from the longitudinal plane of the footwear from the other side of the heel end portion of the footwear;

(c) winding the second end portion of said heel support strap over the base of the instep of the foot of a wearer of the article of footwear, and thence directly downward and under the arch of the foot of said wearer at least one time and back upwardly over said base of the instep, and thence rearwardly and downwardly at an acute angle from the longitudinal plane of the footwear to a fastening position with said first end portion of the heel support strap to form a figure 8, to create a force to pull the rear portion of the foot of said wearer downward and backward into a steadfast engagement with the footwear to provide a positive rear-foot control, while allowing the achilles tendon to function freely from any restrictive strap pressure; and, (d) releasably fastening said first and second heel support strap end portions together.

5. The method of releasably securing the foot of a wearer to an article of footwear as defined in claim 4, wherein:

(a) the heel support strap end portion wound under the arch of the foot of the wearer is disposed under the insole of the footwear.

* * * * *